US008197197B2

(12) United States Patent
Flanagan

(10) Patent No.: US 8,197,197 B2
(45) Date of Patent: Jun. 12, 2012

(54) METHOD OF MATCHING THERMAL RESPONSE RATES BETWEEN A STATOR AND A ROTOR AND FLUIDIC THERMAL SWITCH FOR USE THEREWITH

(75) Inventor: Mark W. Flanagan, Greenville, SC (US)

(73) Assignee: General Electric Company, Schenectady, NY (US)

( * ) Notice: Subject to any disclaimer, the term of this patent is extended or adjusted under 35 U.S.C. 154(b) by 773 days.

(21) Appl. No.: 12/350,624

(22) Filed: Jan. 8, 2009

(65) Prior Publication Data

US 2010/0172738 A1 Jul. 8, 2010

(51) Int. Cl.

| | |
|---|---|
| ***F01D 25/08*** | (2006.01) |
| ***F01D 5/08*** | (2006.01) |
| ***F01D 5/18*** | (2006.01) |
| ***F03B 11/00*** | (2006.01) |
| ***F04D 29/58*** | (2006.01) |

(52) U.S. Cl. ..... 415/177; 415/1

(58) Field of Classification Search ..... 415/1, 17, 415/177

See application file for complete search history.

(56) References Cited

U.S. PATENT DOCUMENTS

| | | | | |
|---|---|---|---|---|
| 2,634,090 | A * | 4/1953 | Hardigg | 415/135 |
| 6,435,823 | B1 * | 8/2002 | Schroder | 415/173.1 |
| 6,733,233 | B2 * | 5/2004 | Jasklowski et al. | 415/135 |

* cited by examiner

*Primary Examiner* — David S Blum

(74) *Attorney, Agent, or Firm* — Sutherland Asbill & Brennan LLP

(57) ABSTRACT

A turbine power generation system with thermal response rate matching provided by one or more fluidic thermal switches and a method for mitigating restart pinch during a hot restart. The turbine power generating system includes a stator and a rotor situated within the casing of the stator. Auxiliary heat is provided to the stator casing during shutdown operations from a heat source via one or more fluidic thermal switch which are configured to provide localized heating to portions of the stator casing subject to restart pinch. The fluidic thermal switch includes two solid, thermal conductors having fluid contacting elements spatially separated within an insulated vessel. A highly conductive and capacitive fluid is provided to the insulated vessel when localized heating is needed.

12 Claims, 5 Drawing Sheets

METHOD OF MATCHING THERMAL RESPONSE RATES BETWEEN A STATOR AND A ROTOR AND FLUIDIC THERMAL SWITCH FOR USE THEREWITH

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention is generally in the field of gas turbine power generation systems. More particularly, the present invention is directed to a method of matching thermal response rates between a rotor and stator and a fluidic thermal switch to be used therewith.

Combustion turbines are often part of a power generation unit. The components of such power generation systems usually include the turbine, a compressor, and a generator. These components are mechanically linked, often employing multiple shafts to increase the unit's efficiency. The generator is generally a separate shaft driven machine. Depending on the size and output of the combustion turbine, a gearbox is sometimes used to couple the generator with the combustion turbine's shaft output.

Generally, combustion turbines operate in what is known as a Brayton Cycle. The Brayton cycle encompasses four main processes: compression, combustion, expansion, and heat rejection. Air is drawn into the compressor, where it is both heated and compressed. The air then exits the compressor and enters a combustor, where fuel is added to the air and the mixture is ignited, thus creating additional heat. The resultant high-temperature, high-pressure gases exit the combustor and enter a turbine, where the heated, pressurized gases pass through the vanes of the turbine, turning the turbine wheel and rotating the turbine shaft. As the generator is coupled to the same shaft, it converts the rotational energy of the turbine shaft into usable electrical energy.

The efficiency of a gas turbine engine depends in part on the clearance between the tips of the rotor blades and the inner surfaces of the stator casing. This is true for both the compressor and the turbine. As clearance increases, more of the engine air flows between the blade tips of the turbine or compressor and the casing without producing useful work, decreasing the engine's efficiency. Too small of a clearance results in contact between the rotor and stator in certain operating conditions.

Because the stator and rotor are exposed to different thermal loads and are commonly made of different materials and thicknesses, the stator and rotor expand and shrink differing amounts during operations. This results in the blade and casing having a clearance that varies with the operating condition. Typically, the cold clearance (the clearance in the cold, stationary operational condition) between the blade and the casing is designed to minimize tip clearance during steady-state operations and to avoid tip rubs during transient operations such as shutdown and startup. These two considerations must be balanced in the cold clearance design, but a transient operating condition usually determines the minimum cold build clearance. As such, the steady state blade clearance is almost always greater than the minimum clearance possible.

The thermal response rate mismatch is most severe for many gas turbine engines during shutdown. This is because rotor purge circuits do not have a sufficient pressure difference to drive cooling flow. This results in a stator casing that cools down much faster than the rotor. Due to thermal expansion, the casing shrinks in diameter faster than the rotor. If a restart is attempted during the time when the casing is significantly colder than the rotor, the mechanical deflection caused by the rotation of the rotor increases the diameter of the rotor, closing the clearance between the rotating and stationary parts (a condition known as "restart pinch").

Thermal response rate mismatch poses a design problem for both the compressor and the turbine. Since the compressor and the turbine are subjected to vastly different thermal loads, minimum and maximum clearances are achieved at different times during transient loading conditions. As such, it would be desirable to provide a device and method for matching the thermal response rate of the stator and rotor.

BRIEF SUMMARY OF THE INVENTION

The present invention comprises turbine power generation system comprising a stator including a casing and a rotor rotatably situated within the casing. The turbine power generation system further comprises a fluidic thermal switch adapted to allow heat to be selectively supplied to the casing. The fluidic thermal switch includes a vessel and a thermal conductor having a first end in thermally-conductive contact with the casing, and a second end extending into the interior of the vessel. A fluid circuit is fluidly connected with the interior of the vessel to selectively supply a fluid to the vessel and alternatively vacate the fluid from the vessel as needed.

In another aspect, the present invention comprises a turbine power generation system comprising a heat source, a heat sink, and a fluidic thermal switch adapted to selectively transfer heat between the heat source and the heat sink. The fluidic thermal switch comprises a vessel and a two thermal conductors. The first thermal conductor has a first end in thermally-conductive contact with the heat sink, and a second end extending into the interior of the vessel. The second thermal conductor has a first end in thermally-conductive contact with the heat source, and a second end extending into the interior of the vessel. The second end of the second thermal conductor is spatially separated from the second end of the first thermal conductor. A fluid circuit is fluidly connected with the interior of the vessel and is configured to selectively supply a thermally conductive fluid to the vessel and vacate the fluid from the vessel when directed.

In another aspect, the present invention comprises a method for mitigating restart pinch during a hot restart. The method comprises (1) providing a gas turbine engine including a stator and a rotor rotatably situated within the casing of the stator; (2) providing an external heat source capable of selectively supplying auxiliary heat to the casing; (3) operating the gas turbine engine for a first period of time at a steady state condition without supplying the auxiliary heat to the casing; and (4) supplying the auxiliary heat to the casing for a second period of time when shutting down the gas turbine after operating at the steady state condition for the first period of time.

DETAILED DESCRIPTION OF THE INVENTION

The present invention comprises a turbine power generation system with thermal response rate matching provided by one or more fluidic thermal switches. The turbine power generating system includes a stator and a rotor situated within the casing of the stator. Auxiliary heat is provided to the stator casing during shutdown operations from a heat source via one or more fluidic thermal switches which are configured to provide localized heating to portions of the stator casing subject to a restart pinch condition.

Figure 1:
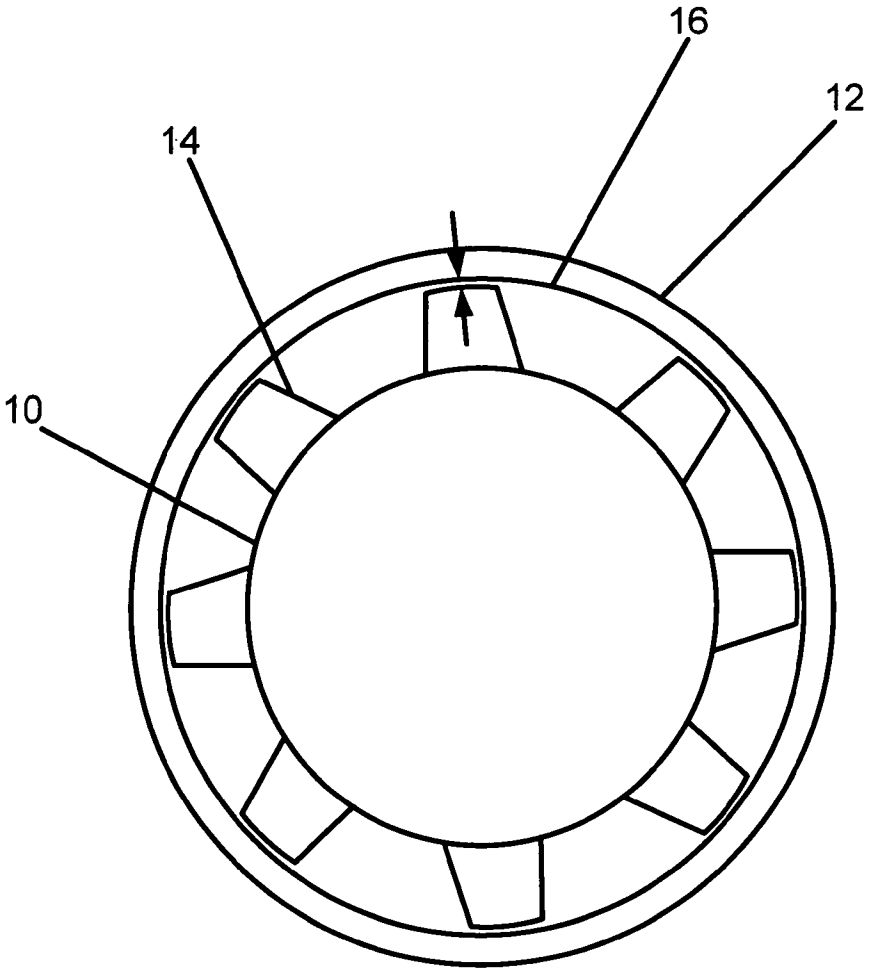
FIG. 1 is a schematic depiction of a rotor and a stator.

FIG. 1 is a depiction of a simple rotor situated within a stator casing. The rotor 10 may include a plurality of blades 14 which are circumferentially situated about the rotor 10. The blades 14 extend in a radial direction from the axis of rotation of the rotor 10 toward the inner surface 16 of the casing of the stator 12. The portion of the blade 14 closest to the inner surface 16 is referred to as the "tip." The clearance between the blade 14 and the inner surface 16 is illustrated by the arrows in FIG. 1. As explained previously, the greatest efficiency is achieved when operating at minimal clearance. This clearance changes as the turbine undergoes transient operations because of the differing thermal response rates of the stator 12 and the rotor 10. In particular, during shutdown operations, the casing 12 cools at a faster rate than the rotor 10. This causes the inside diameter of the inner surface 16 to shrink at a quicker rate than the rotor 10. Because the rotor 10 is rotating a slower rate, there is less mechanical deflection of the blades 14.

A "hot restart" presents a significant problem, however. A hot restart occurs when a gas turbine is fired shortly after a shutdown. Various circumstances may prompt a hot restart. Hot restarts often occur when an error condition causes the gas turbine to shutdown and the error condition is quickly remediated. Hot restarts also occur when an unanticipated energy demand arises shortly after a shutdown or shortly after beginning a shutdown. During a hot restart, the rotor 10 has not fully cooled, so speeding up the rotation of the rotor 10 causes increased mechanical deflection of the blades 14. Because the stator 12 has a reduced inner diameter (due to cooling), the blades 14 may contact the inner surface 16 in what is referred to as a "restart pinch." Similarly, restart pinches may also occur during "warm restarts" such as when shutting down a turbine at night and restarting the turbine eight hours later in the morning.

Figure 4:
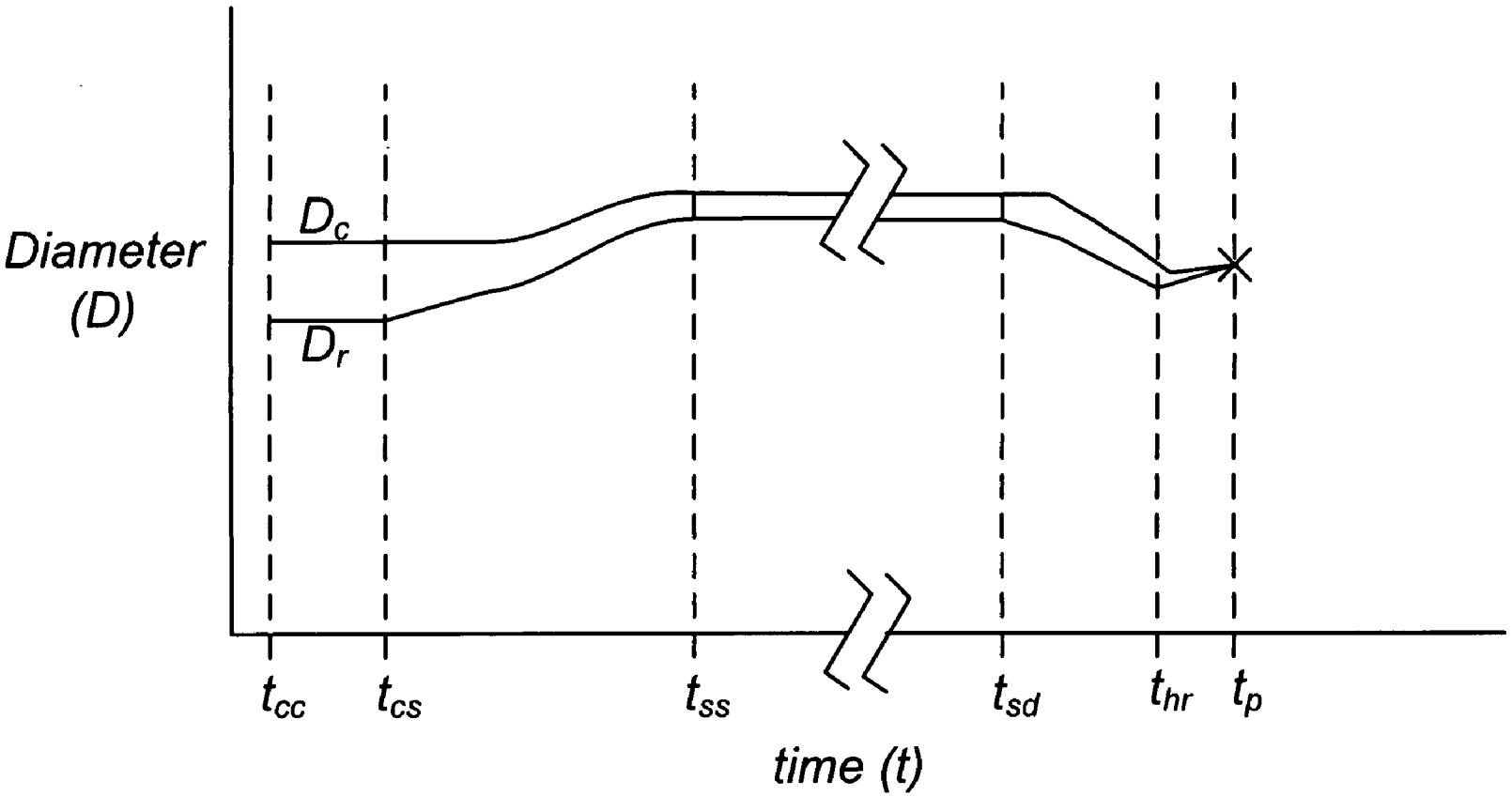
FIG. 4 is a graph, illustrating the change in the clearance between a rotor and stator over time.

FIG. 4 is illustrative of a normal operating process for a gas turbine engine. The top line in the graph, $D_c$, indicates the diameter of the inner surface 16 of the casing 12 during transient and steady-state operations. The bottom line, $D_r$, represents the change in diameter of the outer tip of the blade 14 of the rotor 10 during transient and steady-state operations. At time $t_{cs}$ the rotor 10 is cold and stationary. The "cold clearance" is represented by the separation between $D_c$ and $D_r$ at time $t_{cs}$. At time $t_{cs}$ a cold start is initiated. $D_r$ immediately begins to increase as the rotation of the rotor 10 causes mechanical deflection of the blades 14. Transient operations continue as the gas turbine engine warms to a steady-state thermal equilibrium. During this period of transient operations, the casing 12 and the rotor 10 expand at different rates as they are subjected to thermal loads. At time $t_{ss}$, a steady-state operating condition is achieved and $D_r$ and $D_c$ remain substantially unchanged. Shut down operations are instituted at time $t_{sd}$. At this time, reduced rotational speed of the rotor 10 causes reduced mechanical deflection of the blades 14. The casing 12 begins to cool at a faster rate than the rotor 10 causing the clearance to decrease. At time $t_{hr}$ a hot restart is initiated. This causes increased mechanical deflection of the rotor 10 and an increased thermal expansion of the rotor 10. At time $t_p$ a pinch condition occurs as $D_r$ increases at a faster rate than $D_c$.

In one embodiment, the present invention comprises a method of selectively adding heat to a stator casing using a fluidic thermal switch during a shutdown so as to match the thermal response rate of the rotor. The addition of heat results in a stator casing shrink rate that more closely matches the shrink rate of the rotor. In practicing such a method, it is preferred that the clearance between the tip of blade 14 and inner surface 16 remains constant or increases during the shutdown process. It is further preferred that the heat is applied in a sufficient quantity and for a sufficient duration such that a restart may be performed at any time without causing a pinch condition. The precise amount of heat required and the length of time such heat should be applied to accomplish these objectives depends on the particular design of the gas turbine engine design in use and the operating conditions at shutdown, but such computations may be performed without difficulty by one skilled in the art.

Figure 2:
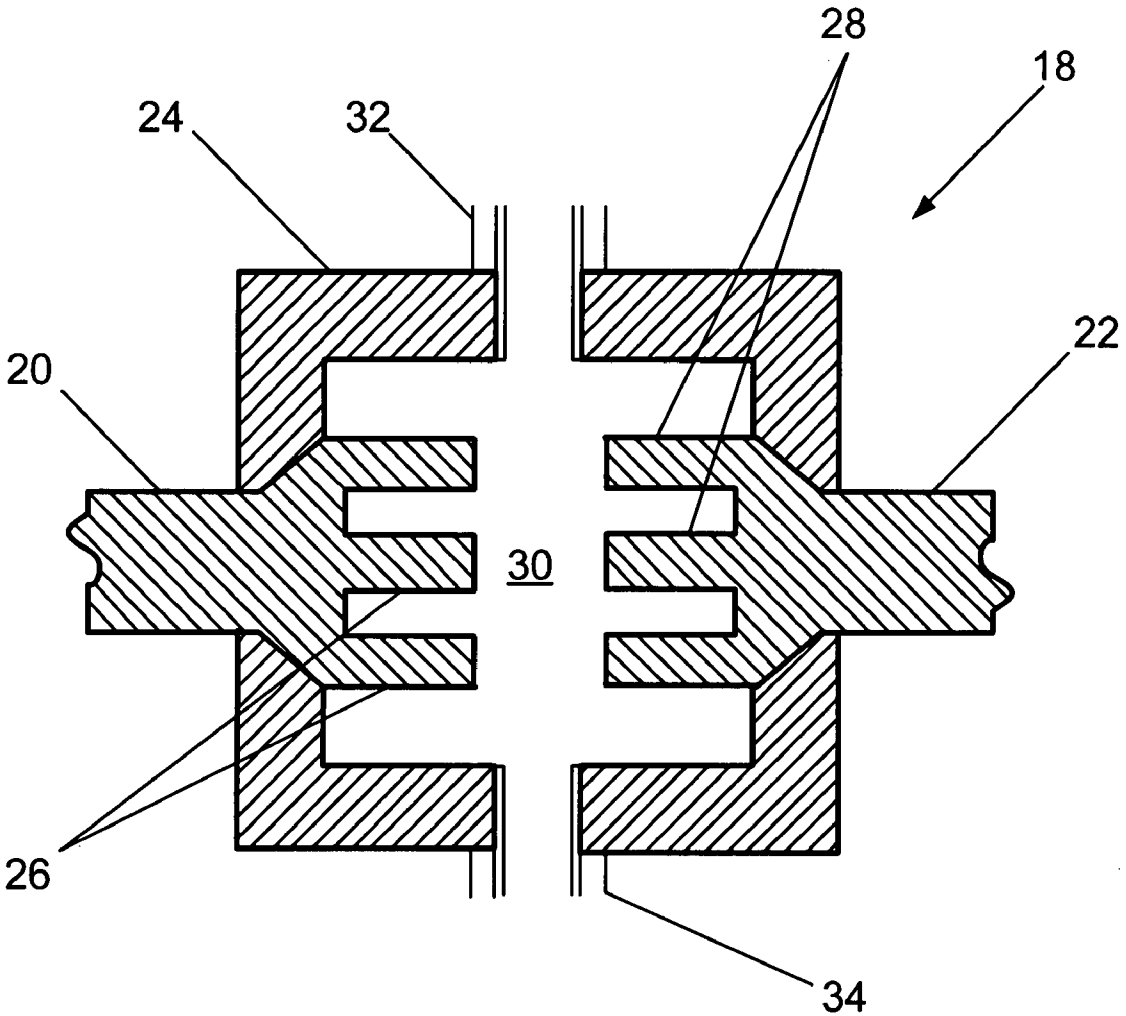
FIG. 2 is a schematic depiction of a fluidic thermal switch.

FIG. 2 illustrates one embodiment of a fluidic thermal switch that may be used to selectively apply heat to a stator casing. The fluidic thermal switch 18 includes a first solid thermal conductor 20 and a second solid thermal conductor 22 which have fluid-contacting elements 26 and 28 spatially separated in a vessel 24. The thermal conductor 20 is in thermally-conductive contact with the stator casing. The thermal conductor 22 is in thermally-conductive contact with a heat source. In one embodiment, heating is provided by heat stored in a thermally conductive fluid. The conductive fluid is heated by the exhaust gases of the turbine engine and then stored until needed. The vessel 24 may be thermally insulated to minimize heat transfer through the walls of the vessel 24.

Two conduits 32 and 34 are provided for selectively supplying and vacating a highly conductive and capacitive fluid in and out of the vessel 24. The fluid contacts the fluid-contacting elements 28 causing heat to be transferred to the fluid. The fluid then transfers the heat to the fluid-contacting elements 26 which conducts heat to the stator casing. Any high-temperature liquid-phase heat transfer fluid may be to fill the vessel 24, but Therminol 66, manufactured by Solutia Inc., is an example of a heat transfer fluid which may be used for such an application. The fluid-contacting elements 28 and 26 are preferably adapted to have enlarged surface areas to improve conductive and convective heat transfer between the fluid and conductors. Instead of the finger-like projections shown in FIG. 2, the thermal conductors 20 and 22 may have ribs, fins, folds or features typically employed in heat exchanger design to increase the rate of heat transfer.

Those that are skilled in the art should now appreciate that the fluidic thermal switch 18 provides a simple mechanism for selectively applying and/or removing auxiliary heat to the stator casing. Fluid is supplied to the vessel 24 when localized heating is needed. The fluid may then be vacated from the vessel 24 when heating is no longer desired. Heat transfer between the thermal conductor 22 and the thermal conductor 20 should be minimal when the fluid is vacated from the interior 30 of the vessel 24. Radiation-type heat transfer between the thermal conductors 22 and 20 may be further reduced by material selection or by employing reflective surface coatings.

Figure 3:
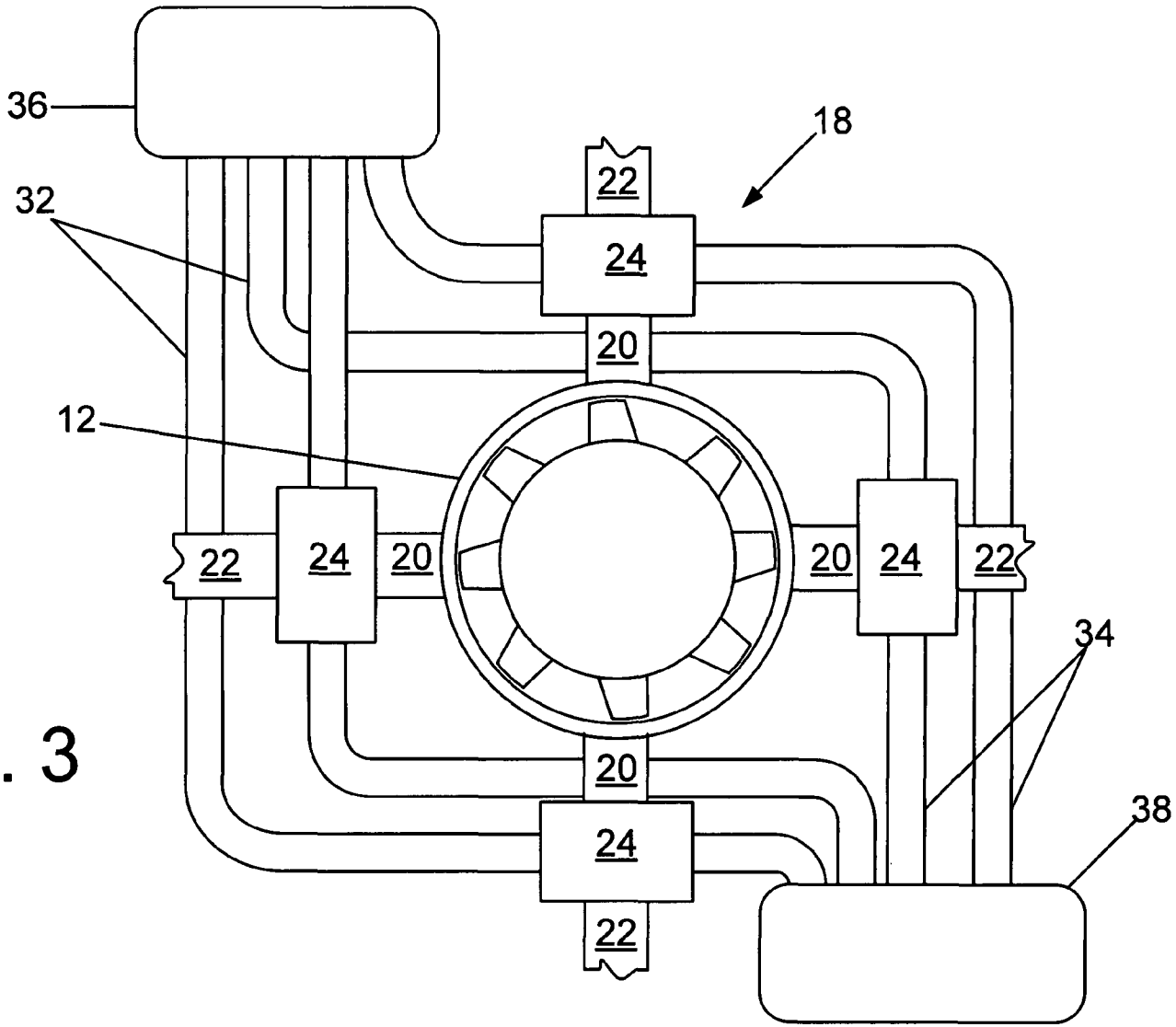
FIG. 3 is a schematic depiction of a series of fluidic thermal switches integrated with a gas turbine engine.

A schematic illustrating an embodiment of the present invention is provided in FIG. 3. In this embodiment, multiple fluidic thermal switches 18 are employed circumferentially about the stator 12, providing heat to portions of the stator 12 which are subject to a restart pinch condition. The fluidic thermal switches 18 may also be employed longitudinally along the length of the turbine engine. The thermal conductors 20 are in thermally-conductive contact with the casing of the stator 12. A distribution manifold 36 contains a large supply of heat transfer fluid. The conduits 32 direct the heat transfer fluid from the distribution manifold 36 to the vessels 24 when auxiliary heating is needed. The conduits 34 vacate the heat transfer fluid from the vessels 24 to a reservoir 38 when heating is no longer required.

It should be understood that the heat supplied via the fluidic thermal switches 18 may be stored in various forms of thermal mass, including, but not limited to various metals and fluids which possess a high thermal capacity. It is preferred that the thermal mass store heat produced by the turbine while the turbine is operating. The fluidic thermal switches 18 may then be utilized to selectively supply heat to the stator on shutdown. In one example, the heat is stored in the conductive fluid itself. In this example, the fluidic thermal switch 18 only needs a single conductor (the conductor 20 of FIG. 3) because the conductive fluid itself is the heat source. Because fluids having a high thermal capacity can be very expensive, it may be desirable to store thermal energy in an alternate source and use the capacitive fluid as a thermal coupler between the two conductors 20 and 22 as illustrated in the example of FIGS. 2 and 3.

In one embodiment, an automatic control system is provided for controlling the flow of heat transfer fluid between a reservoir and the vessels 24. Such an automatic control system would include one or more control valves and/or pumps for supplying and vacating the heat transfer fluid to and from the vessels 24. The pumps and/or control valves may be automatically actuated during a shutdown to provide heat to the casing of the stator 12. The fluid may be evacuated from the vessels 24 after a period of time. The duration may be adjusted based on inputs provided to a controller. For example, the duration auxiliary heat is provided to the stator 12 by the fluidic thermal switches 18 may be dependent upon the operating temperature of the rotor and stator at the time of shutdown.

Figure 5:
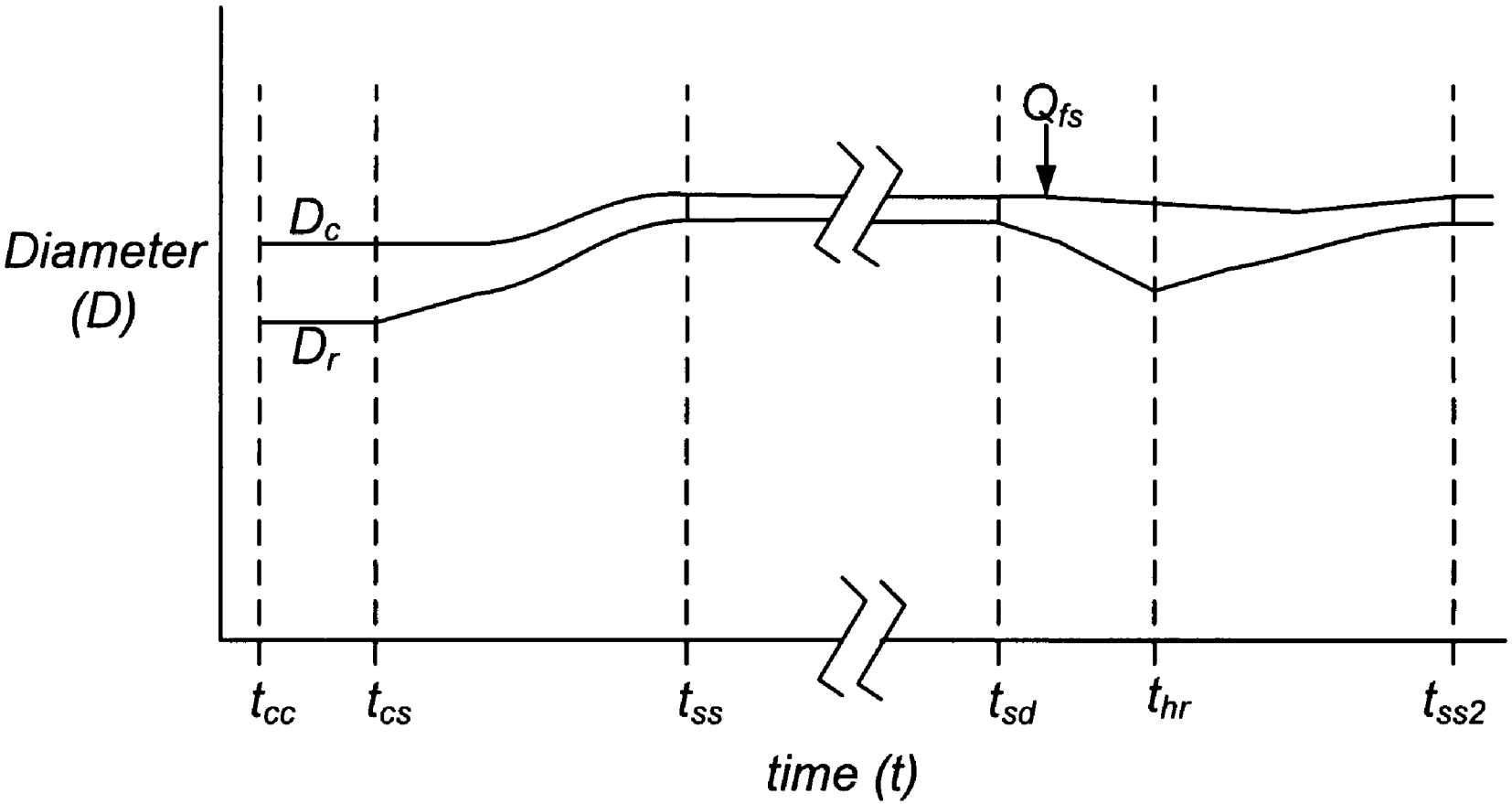
FIG. 5 is a graph, illustrating the change in the clearance between a rotor and stator over time with thermal response matching provided by a fluidic thermal switch.

FIG. 5 is illustrative of a modified operating process for a gas turbine engine. The modified process varies from the normal process after time $t_{sd}$ when shut down operations begin. Upon cessation of steady-state operating conditions heat $Q_{fs}$ is supplied to the stator from the fluidic thermal switch 18. This slows the cooling of the stator and, thus, slows the rate of reduction of $D_c$. As such, at time $t_{hr}$ a hot restart may be initiated without risking a pinch condition. After $t_{hr}$, $D_r$ continues to increase with rotation and thermal loading until a second steady-state condition is achieved at time $t_{ss2}$.

There are many benefits which can be realized by using one or more of the embodiments of the present invention. As discussed previously, embodiments of the present invention may be used to prevent instances of restart pinch on a hot restart. Also, steady-state running clearances may be further minimized since hot restart conditions are no longer a significant design limitation. This provides a significant boost in turbine efficiency with negligible energy cost to the power station.

Furthermore, methods of the present invention which employ auxiliary heat during shutdown are advantageous over methods which reduce hot running clearances solely by preheating during startup. One advantage is that there is a large available supply of "free" and easily-accessible auxiliary heat immediately after steady-state operation. Also, a hot restart may be initiated more quickly with fewer restart pinch instances if auxiliary heating is provided during shutdown instead of during a restart.

The invention is not limited to the specific embodiments disclosed above. Modifications and variations of the methods and devices described herein will be obvious to those skilled in the art from the foregoing detailed description. Such modifications and variations are intended to come within the scope of the appended claims.

I claim:

1. A turbine power generation system, comprising:

a stator including a casing having an inner surface;

a rotor rotatably situated within the casing, the rotor adapted to rotate about an axis of rotation, the rotor comprising a blade, the blade having a tip proximal the inner surface of the casing; and a fluidic thermal switch adapted to allow heat to be selectively supplied to the casing, the fluidic thermal switch including a vessel having an interior;

a first thermal conductor having a first end in thermally-conductive contact with the casing, and a second end extending into the interior of the vessel; and a fluid circuit fluidly communicating with the interior of the vessel configured to selectively supply a fluid to the vessel and alternatively vacate the fluid from the vessel as needed.

2. The turbine power generation system of claim 1, wherein the fluidic thermal switch further comprises a second thermal conductor having a first end in thermally-conductive contact with a heat source, and a second end extending into the interior of the vessel, the second end of the second thermal conductor spatially separated from the second end of the first thermal conductor.

3. The turbine power generation system of claim 1, wherein the interior of the vessel is thermally-insulated.

4. The turbine power generation system of claim 1, further comprising a heat source configured to transfer heat to said first thermal conductor when the fluid is supplied to the vessel.

5. The turbine power generation system of claim 1, wherein the fluid is a high temperature liquid phase heat transfer fluid.

6. The turbine power generation system of claim 1, the fluidic thermal switch adapted to provide a sufficient amount of heat to the casing during shutdown to prevent the tip of the blade from contacting the inner surface of the casing.

7. A turbine power generation system, comprising:

a heat source;

a heat sink; and a fluidic thermal switch adapted to selectively transfer heat between the heat source and the heat sink, the fluidic thermal switch comprising a vessel having an interior;

a first thermal conductor having a first end in thermally-conductive contact with the heat sink, and a second end extending into the interior of the vessel;

a second thermal conductor having a first end in thermally-conductive contact with the heat source, and a second end extending into the interior of the vessel, the second end of the second thermal conductor spatially separated from the second end of the first thermal conductor; and a fluid circuit fluidly communicating with the interior of the vessel configured to selectively supply a fluid to the vessel and vacate the fluid from the vessel when directed.

8. The turbine power generation system of claim 7, wherein the heat sink comprises a casing of a stator, the stator containing a rotor within the casing, the casing having an inner surface, the rotor comprising a blade having a tip proximal the inner surface of the casing.

9. The turbine power generation system of claim 7, wherein the interior of the vessel is thermally-insulated.

10. The turbine power generation system of claim 7, wherein heat source configured to transfer heat to said first thermal conductor when the fluid is supplied to the vessel.

11. The turbine power generation system of claim 7, wherein the fluid is a high temperature liquid phase heat transfer fluid.

12. The turbine power generation system of claim 8, wherein the fluidic thermal switch is adapted to provide a sufficient amount of heat to the casing during shutdown to prevent the tip of the blade from contacting the inner surface of the casing.

* * * * *